US005581055A

United States Patent [19]

Self et al.

[11] Patent Number: 5,581,055

[45] Date of Patent: Dec. 3, 1996

[54] MUFFLER FOR AIR OPERATED HAND TOOLS AND OTHER PNEUMATIC DEVICES

[75] Inventors: Kevin G. Self, Rte. 1, Box 28A, Caddo, Okla. 74729; Brian M. Self, Arkadelphia, Ark.

[73] Assignee: Kevin G. Self, Caddo, Okla.

[21] Appl. No.: 511,607

[22] Filed: Aug. 4, 1995

[51] Int. Cl.[6] ..... F01N 3/02

[52] U.S. Cl. ..... 181/230; 181/237; 181/241

[58] Field of Search ..... 181/230, 224, 181/226, 237, 240, 241, 255, 269, 272, 273

[56] References Cited

U.S. PATENT DOCUMENTS

| | | | |
|---|---|---|---|
| 2,453,240 | 11/1948 | Malmros . | |
| 3,270,834 | 9/1966 | Bratt . | |
| 3,323,615 | 6/1967 | Kessler | 181/230 |
| 3,802,538 | 4/1974 | Brown | 181/230 |
| 3,880,252 | 4/1975 | Mucka | 181/230 |
| 3,891,049 | 6/1975 | Stroezel et al. . | |
| 3,918,549 | 11/1975 | Murphy | 181/230 |
| 4,113,052 | 9/1978 | McElroy . | |
| 4,134,472 | 1/1979 | Trainor | 181/230 X |
| 4,161,996 | 7/1979 | Dolejsi | 181/230 |
| 4,244,442 | 1/1981 | Scarton et al. | 181/230 |

*Primary Examiner*—Khanh Dang
*Attorney, Agent, or Firm*—John W. Wustenberg

[57] ABSTRACT

A retrofittable muffler to reduce noise associated with air-operated hand tools and other working devices provides a housing with an inner expansion chamber and an outer expansion chamber so that at least a portion of spent pneumatic fluid passes from the pneumatic device, through the internal expansion chamber, and through the outer expansion chamber prior to discharge to atmosphere through exhaust ports in the housing.

10 Claims, 3 Drawing Sheets

MUFFLER FOR AIR OPERATED HAND TOOLS AND OTHER PNEUMATIC DEVICES

BACKGROUND OF THE INVENTION

1. Field of the Invention

This invention relates generally to the field of acoustics, and more particularly, but not by way of limitation, to a muffler for air-operated hand tools and other pneumatic devices.

2. Discussion

Air-operated hand tools and other pneumatic devices produce in-plant noise pollution which is harmful to employees. Federal and state regulations govern permissible noise exposure for employees inside a plant and require engineering controls to reduce sound levels below established limits. Many un-muffled air-operated hand tools and other pneumatic devices do not comply with established limits. Attempts to muffle pneumatic devices have been unsatisfactory because either ice forms on the vents or restricted air flow reduces operating efficiency.

U.S. Pat. No. 4,113,052 describes an elastic muffler assembly for a pneumatic device. The '052 muffler directs side-discharged spent pneumatic fluid through sound-attenuating material to exhaust ports. According to the '052 patent, felt having a packing density of approximately 0.005 pounds per cubic inch is the preferred sound-attenuating material. Less dense types of sound-attenuating material do not reduce the noise level of spent working fluid sufficiently, and more dense types of sound-attenuating material were found to increase back pressure inside the pneumatic device and produce icing.

Available methods and devices do not provide a cheap, easily manufactured, effective, retrofittable muffler for reducing the noise level of air-operated hand tools and other pneumatic devices without icing of the vents or unacceptable reduction of operating efficiency.

SUMMARY OF THE INVENTION

The present invention provides a muffler for air-operated hand tools and other pneumatic devices. The present muffler solves the above-mentioned problems related to reduction of objectional sounds without use of sound-attenuating material. The term air-operated hand tools and the term pneumatic devices are used interchangeably herein to refer collectively to air-operated hand tools and other pneumatic devices.

Broadly speaking, the muffler provides a housing adapted to receive spent working fluid from a pneumatic device and to exhaust the spent working fluid to atmosphere; a perforated baffle disposed within the housing to create an inner expansion chamber and an outer expansion chamber so that a portion of spent working fluid from the pneumatic device is directed from the pneumatic device into the inner expansion chamber and through the perforated baffle to the outer expansion chamber prior to discharge to atmosphere; and attachment means for attaching the housing to the pneumatic device. The muffler can be adapted to either front-exhaust pneumatic devices or rear-exhaust pneumatic devices. The muffler also is suited for manufacture as an integral part of pneumatically-powered devices. The muffler reduces the objectionable high-frequency whine normally associated with air-operated hand tools to a sound of rapidly-moving air.

An object of the present invention is to provide an inexpensive, easily manufactured, and effective muffler for air-operated hand tools and pneumatic devices.

Another object of the present invention is to provide a muffler which does not significantly reduce the operating efficiency of air-operated hand tools and other pneumatic devices.

Yet another object of the present invention is to provide a muffler which can be easily installed on existing front-exhaust or rear-exhaust pneumatic devices.

Yet another object of the present invention is to provide a muffler which does not contain sound-attenuating materials taught in the prior art.

Yet another object of the present invention is to provide a muffler for pneumatic devices which includes a regulator for controlling the speed of the pneumatic device.

Other objects, features, and advantages of the present invention will become clear from the following description of the preferred embodiment when read in conjunction with the accompanying drawings and appended claims.

DETAILED DESCRIPTION OF THE INVENTION

In the following description of the present invention, like numerals and characters designate like elements throughout the figures of the drawings.

Figure 1:
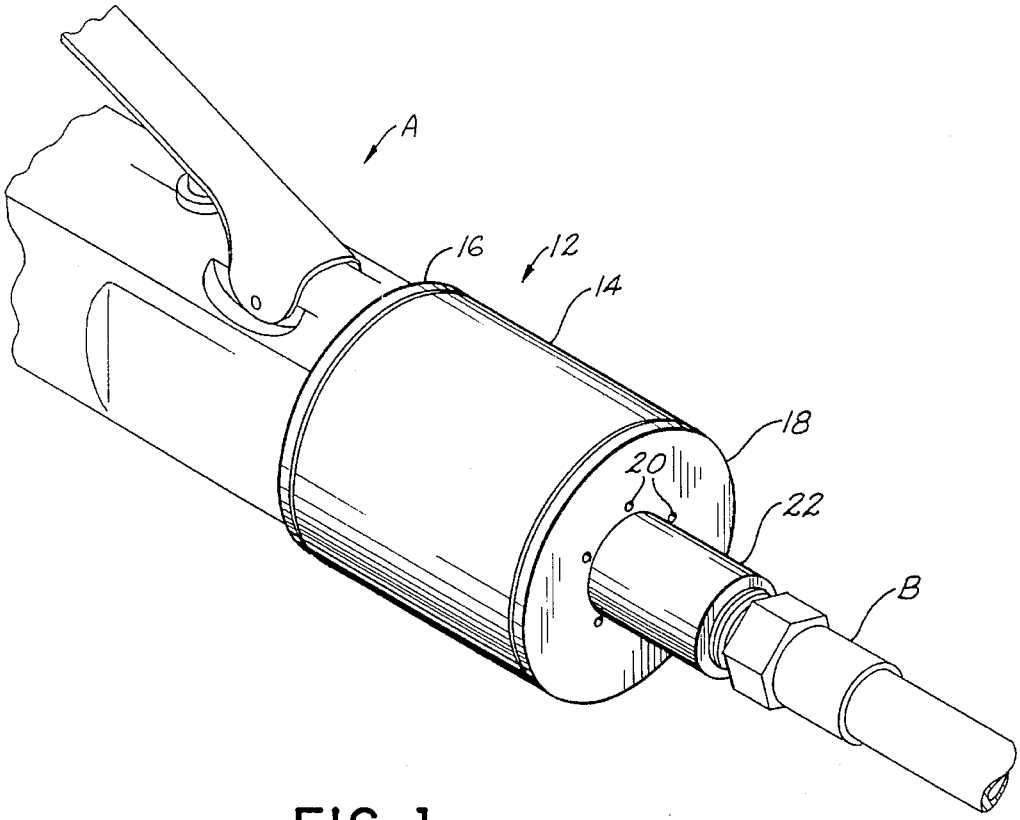
FIG. 1 is a pictorial view of a first embodiment of the muffler installed on a rear-exhaust air-operated hand tool in accordance with the present invention.

Referring generally to the drawings and more particularly to FIG. 1, a muffler 10 is shown in conjunction with a pneumatic device A. A housing 12 is formed by cylindrical enclosure 14, end cap 16 and exhaust end cap 18. Exhaust ports 20 permit spent pneumatic fluid to pass from within the housing 12 to atmosphere. A pneumatic supply line connector 22 connects a supply line B to an air supply conduit (not shown in FIG. 1 ) connected to the pneumatic device A.

Figure 2:
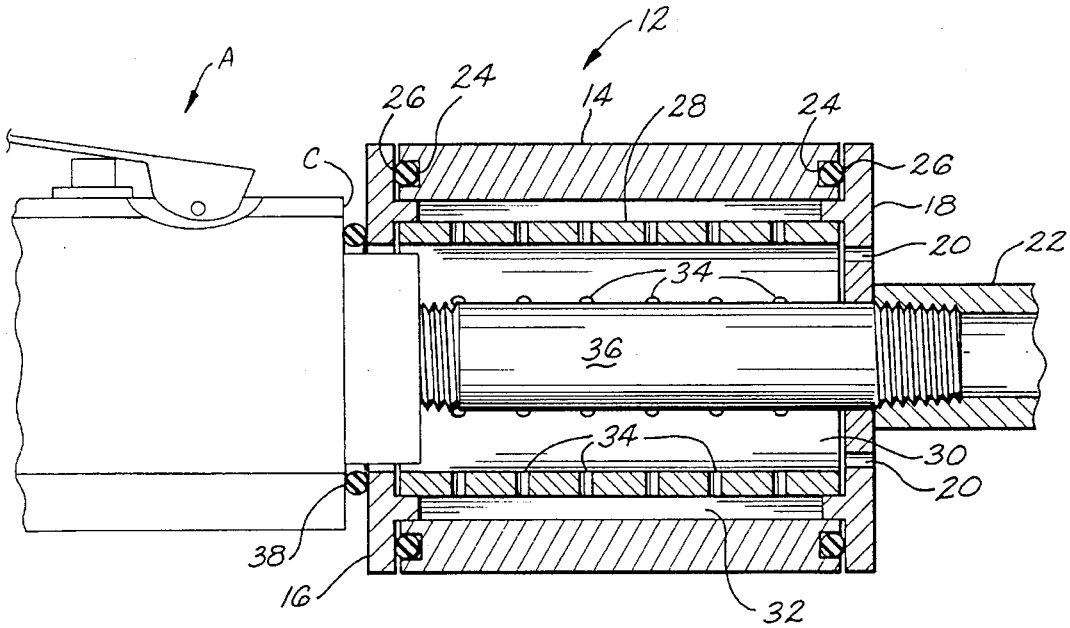
FIG. 2 is a cross-sectional view of the muffler depicted in FIG. 1.

Referring now to FIG. 2, shown therein is a cross-section of the muffler 10 depicted in FIG. 1. An O-Ring groove 24 at one end of the cylindrical enclosure 14 is adapted to receive an O-Ring 26 to create a seal between the cylindrical enclosure 14 and the end cap 16. A like O-Ring groove 24 at the opposite end of the cylindrical enclosure 14 is adapted to receive a second O-Ring 26 to form a seal between the cylindrical enclosure 14 and the exhaust end cap 18. A perforated baffle 28 between the end cap 16 and the exhaust end cap 18 creates an inner expansion chamber 30 and an outer expansion chamber 32. A plurality of orifices 34 provide communication between the inner expansion chamber 30 and the outer expansion chamber 32. The pneumatic supply line connector 22 is threaded to an air supply conduit 36. The air supply conduit 36 is of an appropriate length so that the housing 12 compresses an O-Ring 38 between the end cap 16 and the case C of the pneumatic device "when the pneumatic supply line connector 22 is threaded sufficiently far on the air supply conduit 36" thus mounting the muffler 10 to the pneumatic device A.

Although the presently preferred embodiment of the muffler 10 uses O-Ring seals to seal the end cap 16 and the exhaust end cap 18 to the cylindrical enclosure 14, it will be understood by those skilled in the art that any suitable means for attaching the end cap 16 and the exhaust end cap 18 to the cylindrical enclosure 14 can be substituted for the O-Ring seals.

Figures 3, 4, 5:
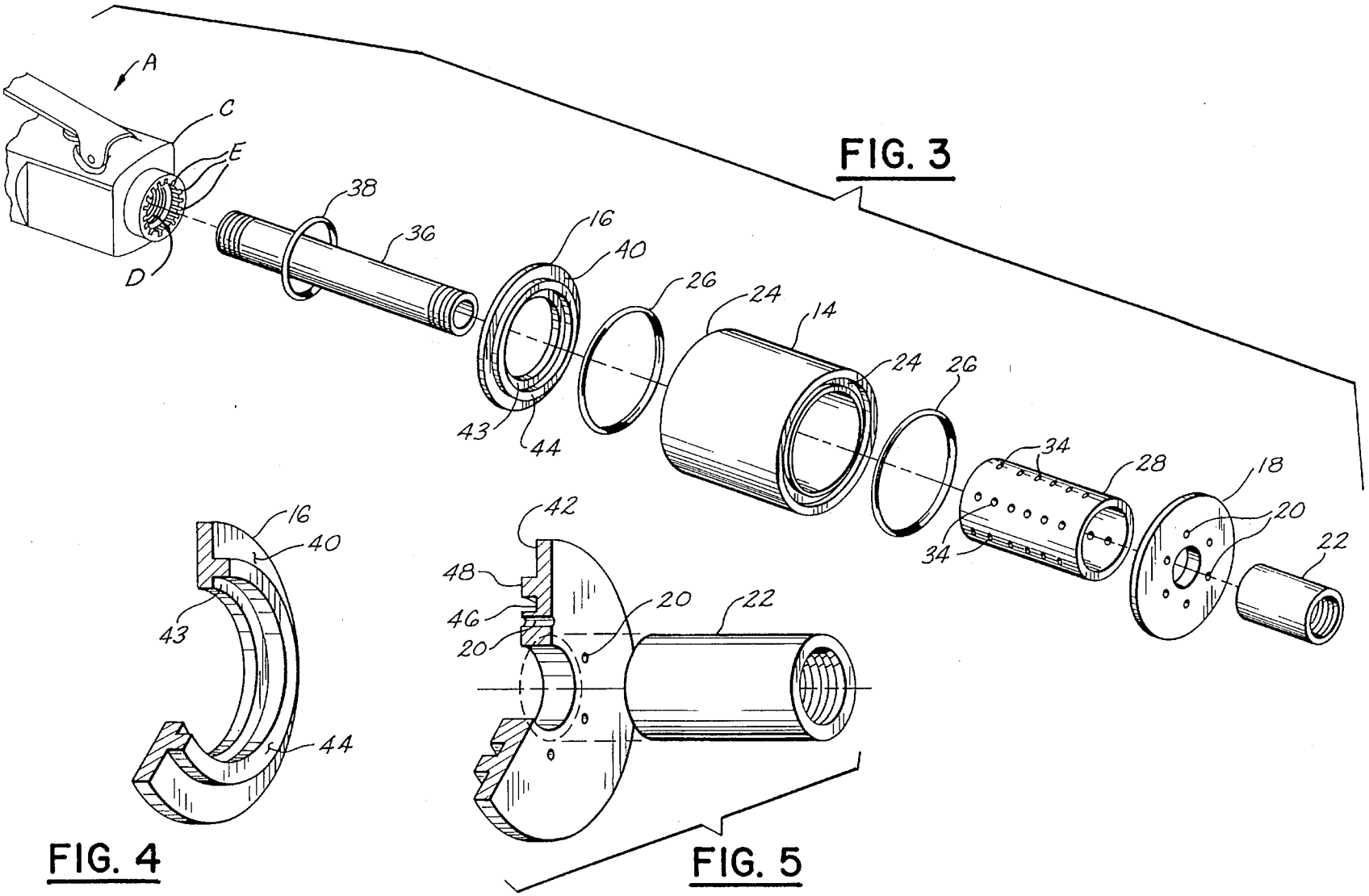
FIG. 3 is an exploded view of the muffler depicted in FIGS. 1 and 2.
FIG. 4 is a detail of the muffler depicted in FIGS. 1—3.
FIG. 5 is a further detail of the muffler depicted in FIGS. 1—3.

Referring now to FIG. 3, shown therein is an exploded view of the muffler 10 attached to a pneumatic device A. The air supply conduit 36 of the first embodiment is a pipe nipple. One end of the air supply conduit 36 is threaded into the air inlet D of the pneumatic device A. Spent pneumatic fluid passes through ducts E in the pneumatic device A into the inner expansion chamber 30 (FIG. 2). A portion of the spent pneumatic fluid passes from the inner expansion chamber 30 through the orifices 34 to the outer expansion chamber 32 (FIG. 2). One end of the cylindrical enclosure 14 is sealed against an end cap O-Ring sealing surface 40 located on the end cap 16 by means of the O-Ring 26. The opposite end of the cylinder enclosure 14 is sealed against an O-Ring sealing surface 42 located on the exhaust end cap 18 (FIG. 5) by means of O-Ring 26.

Referring now to FIG. 3 in conjunction with FIGS. 4 and 5, one end of the perforated baffle 28 is seated against a seat 43 located on the end cap 16. A circular rib 44 in the end cap 16 separates the perforated baffle 28 from the cylindrical enclosure 14. The opposite end of the perforated baffle 28 is seated in a channel 46 in the exhaust end cap 18. A circular rib 48 in the exhaust end cap 18 separates the perforated baffle 28 from the cylindrical enclosure 14. The inner expansion chamber 30 is between the air supply conduit 36 and the perforated baffle 28. The outer expansion chamber 32 is between the perforated baffle 28 and the cylindrical enclosure 14.

Figure 6:
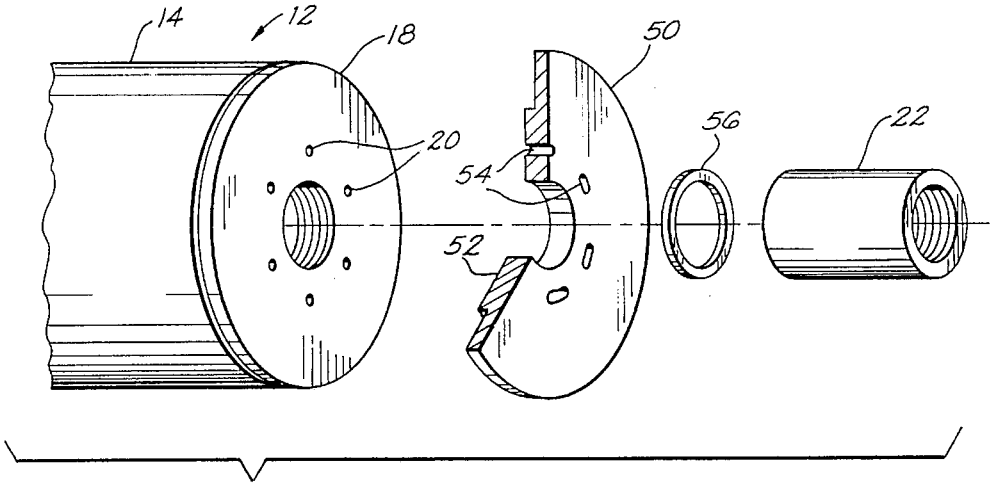
FIG. 6 is an exploded view of a speed-regulating muffler.
Figure 7:
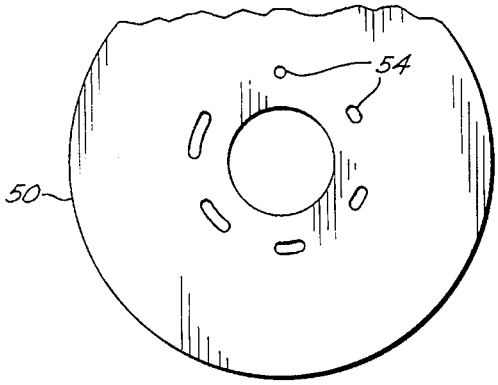
FIG. 7 is a further detail of the speed-regulating muffler of FIG. 6.

Referring now to FIGS. 6 and 7, shown therein is a speed-regulating muffler 11. A regulator end cap 50 having an interior face 52 is rotatably positioned against the exhaust end cap 18. The regulator end cap 50 is structurally similar to the exhaust end cap 18 but contains arcuate slots 54 in place of the exhaust ports 20. The position of the arcuate slots 54 in the regulator end cap 50 relative to the exhaust ports 20 in the exhaust end cap 18 varies the amount of spent pneumatic fluid which is permitted to pass through the exhaust ports 20 and the arcuate slots 54 to atmosphere. The pneumatic supply line connector 22 is threaded to the air supply conduit 36 to compress a washer 56 against the regulator end cap 50, thus compressing the interior face 52 of the regulator end cap 50 against the exhaust end cap 18.

The regulator end cap 50 can be knurled about its circumference to permit ease of rotation. Similarly, tabs or bosses spaced around the circumference of the regulator end cap 50 will permit an operator to easily adjust the position of the arcuate slots 54 relative to the exhaust ports 20.

Figure 8:
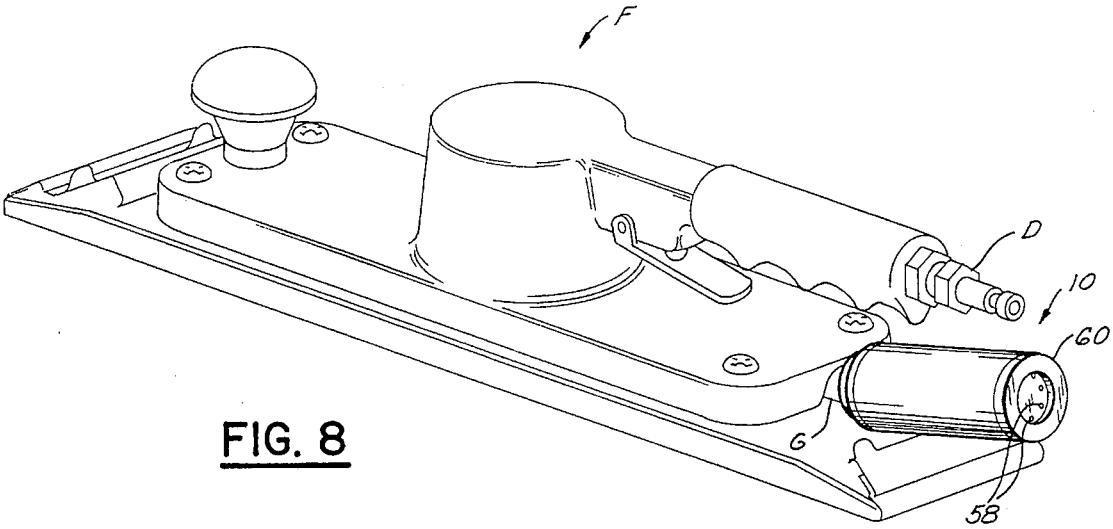
FIG. 8 is a pictorial view of another embodiment of the muffler installed on a pneumatic device having an exhaust separate from the air supply.

Referring now to FIG. 8, shown therein is another embodiment of the muffler 10 attached to a pneumatic device F. In the pneumatic device F, the air inlet D is separate from the exhaust G, and the muffler 10 attaches directly to the exhaust G. The perforated baffle (not shown) extends through the end cap (not shown) so the inside diameter of the perforated baffle extension frictionally engages the outer diameter of the exhaust G of the pneumatic device F. Spent pneumatic fluid is discharged through exhaust ports 58 in exhaust end cap 60.

The muffler is suited for attachment to existing air-operated hand tools. The muffler can also be incorporated into the original design and manufacture of pneumatic devices.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A muffler for air-operated hand tools and other pneumatic devices, comprising:

a housing adapted to receive spent working fluid from the pneumatic device and to exhaust the spent working fluid to atmosphere;

a perforated baffle disposed within said housing to create an inner expansion chamber and an outer expansion chamber, said inner expansion chamber communicating with both said outer expansion chamber and the atmosphere, and said outer expansion chamber being sealed from the atmosphere so that spent working fluid from the pneumatic device is directed from the pneumatic device into said inner expansion chamber whereby spent working fluid can be exchanged between said inner expansion chamber and said outer expansion chamber through said perforated baffle, and whereby the spent working fluid can be discharged to atmosphere only from said inner expansion chamber; and mounting means for mounting said housing to the pneumatic device.

2. The muffler as recited in claim 1, wherein said housing further comprises:

a cylindrical enclosure;

an end cap having a seat adapted to receive one end of said perforated baffle;

an exhaust end cap having a channel adapted to receive the other end of said perforated baffle, said exhaust end cap having a plurality of exhaust ports through which spent working fluid passes from said inner expansion chamber to atmosphere; and sealing means for sealing said end cap and said exhaust end cap to said cylindrical enclosure.

3. The muffler as recited in claim 1, wherein said housing further comprises:

a cylindrical enclosure;

an end cap sealed to one end of said cylindrical enclosure, said end cap having an aperture adapted to receive said mounting means, said end cap further adapted to receive one end of said perforated baffle; and an exhaust end cap sealed to the other end of said perforated baffle, said exhaust end cap having a plurality of exhaust ports through which spent working fluid passes from said inner expansion chamber to atmosphere.

4. The muffler as recited in claim 1, wherein said mounting means further comprises:

an O-Ring disposed between said end cap and the case of the pneumatic device;

an air supply conduit axially disposed within said inner expansion chamber, one end of said air supply conduit engaging the inlet of the pneumatic device and the other end of said air supply conduit extending through said exhaust end cap; and a pneumatic supply line connector, said pneumatic supply line connector engaging said air supply conduit so said housing is biased against said O-Ring disposed between said end cap and the exhaust of the pneumatic device.

5. A speed-regulating muffler for air-operated hand tools and other pneumatic devices, comprising:

a housing adapted to receive spent working fluid from the pneumatic device and to exhaust the spent working fluid to atmosphere;

a perforated baffle disposed within said housing to create an inner expansion chamber and an outer expansion chamber, said inner expansion chamber communicating with both said outer expansion chamber and the atmosphere, and said outer expansion chamber sealed from the atmosphere so that spent working fluid from the pneumatic device is directed from the pneumatic device into said inner expansion chamber whereby spent working fluid can be exchanged between said inner expansion chamber and said outer expansion chamber through said perforated baffle, although the spent working fluid can be discharged to atmosphere only from said inner expansion chamber;

mounting means for mounting said housing to the pneumatic device; and speed-regulating means attached to said housing for varying the flow of spent working fluid from said inner expansion chamber to atmosphere and thereby adjusting the speed of the pneumatic device.

6. The speed-regulating muffler as recited in claim 5, wherein said housing further comprises:

a cylindrical enclosure;

an end cap having a seat adapted to receive one end of said perforated baffle;

an exhaust end cap having a channel adapted to receive the other end of said perforated baffle, said exhaust end cap having a plurality of exhaust ports through which spent working fluid passes from said inner expansion chamber to atmosphere; and sealing means for sealing said end cap and said exhaust end cap to said cylindrical enclosure.

7. The speed-regulating muffler as recited in claim 6, wherein said speed-regulating means further comprises:

a regulator end cap having a plurality of arcuate slots, said regulator end cap generally matching said exhaust end cap in structure and shape, so that said arcuate slots can be positioned to permit flow of spent working fluid through said exhaust ports and said arcuate slots to atmosphere;

positioning means for juxtapositioning said regulator end cap adjacent to said exhaust end cap; and rotating means for rotating said regulator end cap to restrict flow of spent working fluid through said exhaust ports and said arcuate slots to atmosphere and thereby adjust the speed of the pneumatic device.

8. The speed-regulating muffler as recited in claim 7, wherein said regulator end cap is knurled around the outer circumference of said regulator end cap to permit easy rotation of said regulator end cap to alter the position of said arcuate slots relative to said exhaust ports in said exhaust end cap.

9. The speed-regulating muffler as recited in claim 7, wherein said regulator end cap includes bosses around the outer circumference of said regulator end cap to permit easy rotation of said regulator end cap to alter the position of said arcuate slots relative to said exhaust ports in said exhaust end cap.

10. The muffler as recited in claim 1, wherein said housing further comprises:

a cylindrical enclosure having an interior groove on each end;

a sealing ring disposed within each said interior groove;

an exhaust end cap having a channel adapted to receive one end of said perforated baffle, said exhaust end cap having a plurality of exhaust ports through which spent working fluid passes from said inner expansion chamber to atmosphere; and an end cap having a seat adapted to receive the other end of said perforated baffle whereby said perforated baffle is biased against said seat of said end cap and the other end of said perforated baffle rests within said channel of said exhaust end cap when said end cap and said exhaust end cap are compressed against said cylindrical enclosure by said mounting means.

* * * * *